US009046843B2

(12) United States Patent
Fujii et al.

(10) Patent No.: US 9,046,843 B2
(45) Date of Patent: Jun. 2, 2015

(54) FIXING DEVICE AND IMAGE FORMING APPARATUS

(71) Applicants: Tomohiko Fujii, Hyogo (JP); Shigeo Nanno, Kyoto (JP); Yutaka Naitoh, Hyogo (JP); Minoru Toyoda, Hyogo (JP); Hitoshi Fujiwara, Osaka (JP); Tomoya Adachi, Hyogo (JP); Yasuharu Kawarasaki, Osaka (JP)

(72) Inventors: Tomohiko Fujii, Hyogo (JP); Shigeo Nanno, Kyoto (JP); Yutaka Naitoh, Hyogo (JP); Minoru Toyoda, Hyogo (JP); Hitoshi Fujiwara, Osaka (JP); Tomoya Adachi, Hyogo (JP); Yasuharu Kawarasaki, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/017,383

(22) Filed: Sep. 4, 2013

(65) Prior Publication Data

US 2014/0099146 A1 Apr. 10, 2014

(30) Foreign Application Priority Data

Oct. 4, 2012 (JP) ..... 2012-222292

(51) Int. Cl.
*G03G 15/16* (2006.01)
*G03G 15/20* (2006.01)

(52) U.S. Cl.
CPC ..... *G03G 15/2089* (2013.01); *G03G 15/206* (2013.01)

(58) Field of Classification Search
CPC ..... G03G 15/2089
USPC ..... 399/122, 124
See application file for complete search history.

(56) References Cited

U.S. PATENT DOCUMENTS

| | | | | |
|---|---|---|---|---|
| 8,023,861 | B2 * | 9/2011 | Yoshinaga et al. | 399/122 |
| 8,073,375 | B2 * | 12/2011 | Hiraoka et al. | 399/122 X |
| 2008/0056783 | A1 | 3/2008 | Yamamoto et al. | |
| 2008/0193162 | A1 | 8/2008 | Yamazoe et al. | |
| 2009/0010680 | A1 | 1/2009 | Nanno | |
| 2009/0060572 | A1 | 3/2009 | Naitoh et al. | |
| 2009/0074440 | A1 | 3/2009 | Nanno et al. | |
| 2009/0110449 | A1 | 4/2009 | Saito et al. | |
| 2009/0123202 | A1 | 5/2009 | Yoshinaga et al. | |
| 2009/0129836 | A1 | 5/2009 | Sakaya et al. | |
| 2010/0034548 | A1 | 2/2010 | Naitoh et al. | |
| 2010/0232848 | A1 | 9/2010 | Naitoh | |
| 2011/0008082 | A1 | 1/2011 | Nanno | |

(Continued)

FOREIGN PATENT DOCUMENTS

| | | |
|---|---|---|
| JP | 2002-148992 | 5/2002 |
| JP | 2009-122243 | 6/2009 |

*Primary Examiner* — Sandra Brase

(74) *Attorney, Agent, or Firm* — Harness, Dickey & Pierce, P.L.C.

(57) ABSTRACT

A fixing device includes a fixing rotary body and a pressing rotary body disposed opposite the fixing rotary body. A pivotable pressurization member contacts and presses the pressing rotary body against the fixing rotary body. A pressurization pivot is provided on the pressurization member. A depressurization member, pivotable about the pressurization pivot, causes the pressurization member to isolate the pressing rotary body from the fixing rotary body. A depressurization pivot is provided on the depressurization member. A lock is pivotable about the depressurization pivot and engageable with the pressurization pivot. A biasing member, anchored to the lock, exerts a resilient bias that allows the lock to cause the pressurization member to press the pressing rotary body against the fixing rotary body. A detent is situated in a pivotal trajectory of the lock to restrict pivot of the lock by contacting the lock.

20 Claims, 8 Drawing Sheets

(56) References Cited

U.S. PATENT DOCUMENTS

| | | | |
|---|---|---|---|
| 2011/0026944 | A1 | 2/2011 | Naitoh |
| 2011/0142495 | A1 | 6/2011 | Nanno |
| 2012/0020681 | A1 | 1/2012 | Naitoh et al. |
| 2012/0177422 | A1 | 7/2012 | Nanno et al. |
| 2012/0275834 | A1 | 11/2012 | Naitoh et al. |
| 2013/0064586 | A1 | 3/2013 | Adachi et al. |

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2012-222292, filed on Oct. 4, 2012, in the Japanese Patent Office, the entire disclosure of which is hereby incorporated by reference herein.

BACKGROUND

1. Technical Field

Example embodiments generally relate to a fixing device and an image forming apparatus, and more particularly, to a fixing device for fixing a toner image on a recording medium and an image forming apparatus incorporating the fixing device.

2. Discussion of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotary body heated by a heater and a pressing rotary body pressed against the fixing rotary body to form a fixing nip therebetween through which a recording medium bearing a toner image is conveyed. As the recording medium is conveyed through the fixing nip, the fixing rotary body and the pressing rotary body apply heat and pressure to the recording medium, melting and fixing the toner image on the recording medium.

The image forming apparatuses incorporating such fixing device are requested to be downsized and capable of forming the toner image on the recording medium quickly. To address this request, the fixing device may incorporate the fixing rotary body and the pressing rotary body that have a decreased diameter. However, the fixing nip formed between the smaller fixing rotary body and the smaller pressing rotary body may have a decreased length in a recording medium conveyance direction. As the recording medium is conveyed through the smaller fixing nip at an increased speed, the recording medium may receive a decreased amount of heat from the fixing rotary body that is insufficient to melt and fix the toner image on the recording medium precisely.

To address this circumstance, a pressurization lever may press the pressing rotary body against the fixing rotary body with increased pressure to form the greater fixing nip between the pressing rotary body and the fixing rotary body. However, a greater force may be required to isolate the pressing rotary body from the fixing rotary body.

To address this circumstance, a depressurization lever pivotable in accordance with a cover of the fixing device may be coupled to the pressurization lever. For example, as a user closes the cover, the depressurization lever causes the pressurization lever to press the pressing rotary body against the fixing rotary body. Conversely, as the user opens the cover, the depressurization lever causes the pressurization lever to isolate the pressing rotary body from the fixing rotary body. Accordingly, as the user closes and opens the cover with a reduced force, the pressing rotary body is pressed against and isolated from the fixing rotary body.

However, if the fixing device is installed in the downsized image forming apparatus, a pivot, that is, a fulcrum, of the depressurization lever about which the depressurization lever pivots as the cover is opened and closed is spaced apart from an effort point where the pressurization lever presses the pressing rotary body against the fixing rotary body and isolates the pressing rotary body from the fixing rotary body with a decreased distance therebetween. Accordingly, a force exerted by the user to open and close the cover may not be amplified. Consequently, the user may be requested to exert an increased force to open and close the cover, degrading usability of the fixing device.

SUMMARY

At least one embodiment may provide a fixing device that includes a fixing rotary body and a pressing rotary body disposed opposite the fixing rotary body. A pivotable pressurization member contacts and presses the pressing rotary body against the fixing rotary body. A pressurization pivot is provided on the pressurization member. A depressurization member, pivotable about the pressurization pivot, causes the pressurization member to isolate the pressing rotary body from the fixing rotary body. A depressurization pivot is provided on the depressurization member. A lock is pivotable about the depressurization pivot and engageable with the pressurization pivot. A biasing member, anchored to the lock, exerts a resilient bias that allows the lock to cause the pressurization member to press the pressing rotary body against the fixing rotary body. A detent is situated in a pivotal trajectory of the lock to restrict pivot of the lock by contacting the lock.

At least one embodiment may provide an image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
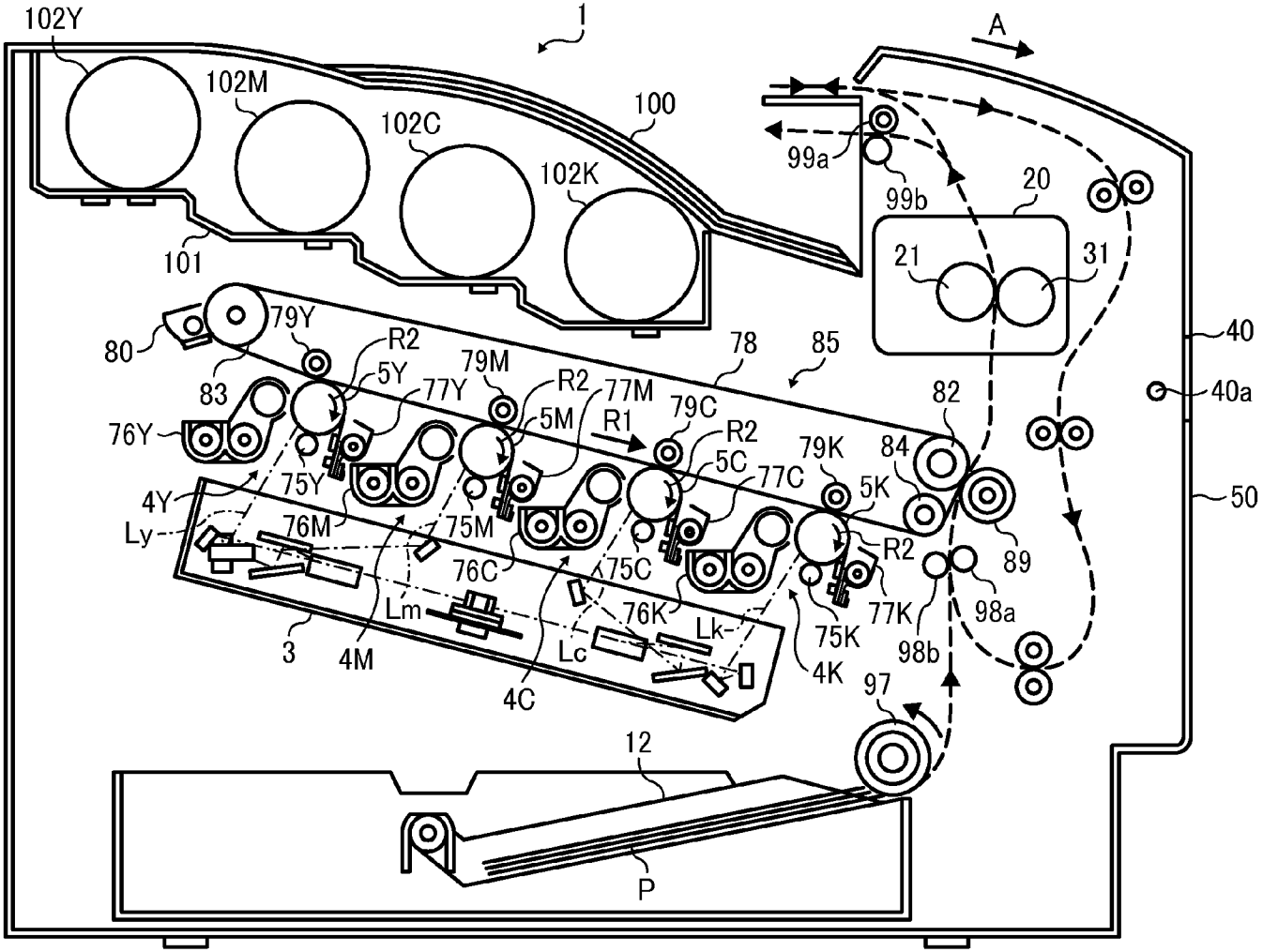
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a tandem color printer that forms color and monochrome toner images on recording media by electrophotography.

As shown in FIG. 1, the image forming apparatus 1 includes image forming devices 4Y, 4M, 4C, and 4K that form yellow, magenta, cyan, and black toner images, respectively, a paper tray 12, a fixing device 20, a front cover 40 serving as a cover, an intermediate transfer unit 85, and a bottle holder 101.

The bottle holder 101 situated in an upper portion of the image forming apparatus 1 holds four toner bottles 102Y, 102M, 102C, and 102K detachably attached thereto and containing fresh yellow, magenta, cyan, and black toners, respectively.

Below the bottle holder 101 is the intermediate transfer unit 85 that includes an intermediate transfer belt 78, four primary transfer bias rollers 79Y, 79M, 79C, and 79K, an intermediate transfer belt cleaner 80, a secondary transfer backup roller 82, a cleaning backup roller 83, and a tension roller 84. The intermediate transfer belt 78 of the intermediate transfer unit 85 is disposed opposite the image forming devices 4Y, 4M, 4C, and 4K aligned along a rotation direction R1 of the intermediate transfer belt 78. The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, cleaners 77Y, 77M, 77C, and 77K, and dischargers, respectively.

A description is provided of image forming processes performed on the photoconductive drums 5Y, 5M, 5C, and 5K.

A driver (e.g., a motor) drives and rotates the photoconductive drums 5Y, 5M, 5C, and 5K clockwise in FIG. 1 in a rotation direction R2. The image forming processes include a charging process, an exposure process, a development process, a primary transfer process, and a cleaning process.

In the charging process, the chargers 75Y, 75M, 75C, and 75K disposed opposite the photoconductive drums 5Y, 5M, 5C, and 5K uniformly charge an outer circumferential surface of the respective photoconductive drums 5Y, 5M, 5C, and 5K.

In the exposure process, an exposure device 3 situated below the photoconductive drums 5Y, 5M, 5C, and 5K emits laser beams Ly, Lm, Lc, and Lk onto the charged outer circumferential surface of the respective photoconductive drums 5Y, 5M, 5C, and 5K that scan and expose the outer circumferential surface of the respective photoconductive drums 5Y, 5M, 5C, and 5K according to yellow, magenta, cyan, and black image data sent from an external device such as a client computer, thus forming electrostatic latent images thereon.

In the development process, the development devices 76Y, 76M, 76C, and 76K disposed opposite the photoconductive drums 5Y, 5M, 5C, and 5K develop the electrostatic latent images formed on the photoconductive drums 5Y, 5M, 5C, and 5K with yellow, magenta, cyan, and black toners supplied from the toner bottles 102Y, 102M, 102C, and 102K into yellow, magenta, cyan, and black toner images, respectively.

The photoconductive drums 5Y, 5M, 5C, and 5K are disposed opposite the primary transfer bias rollers 79Y, 79M, 79C, and 79K via the intermediate transfer belt 78 to form primary transfer nips between the intermediate transfer belt 78 and the photoconductive drums 5Y, 5M, 5C, and 5K, respectively. In the primary transfer process, the primary transfer bias rollers 79Y, 79M, 79C, and 79K primarily transfer the yellow, magenta, cyan, and black toner images formed on the photoconductive drums 5Y, 5M, 5C, and 5K, respectively, onto the intermediate transfer belt 78. After the primary transfer process, a slight amount of residual toner failed to be transferred onto the intermediate transfer belt 78 remains on the photoconductive drums 5Y, 5M, 5C, and 5K.

To address this circumstance, in the cleaning process, a cleaning blade of the respective cleaners 77Y, 77M, 77C, and 77K disposed opposite the photoconductive drums 5Y, 5M, 5C, and 5K mechanically collects the residual toner from the photoconductive drums 5Y, 5M, 5C, and 5K. Finally, the discharger disposed opposite the respective photoconductive drums 5Y, 5M, 5C, and 5K removes residual potential from the photoconductive drums 5Y, 5M, 5C, and 5K.

A description is provided of the primary transfer process and a secondary transfer process performed on the intermediate transfer belt 78 after the image forming processes described above.

The intermediate transfer belt 78 is stretched taut across the secondary transfer backup roller 82, the cleaning backup roller 83, and the tension roller 84. The four primary transfer bias rollers 79Y, 79M, 79C, and 79K and the photoconductive drums 5Y, 5M, 5C, and 5K sandwich the intermediate transfer belt 78 to form the primary transfer nips between the photoconductive drums 5Y, 5M, 5C, and 5K and the intermediate transfer belt 78. A transfer bias having a polarity opposite a polarity of toner is applied to the primary transfer bias rollers 79Y, 79M, 79C, and 79K. As the secondary transfer backup roller 82 drives and rotates the intermediate transfer belt 78 in the rotation direction R1, the yellow, magenta, cyan, and black toner images formed on the photoconductive drums 5Y, 5M, 5C, and 5K are primarily transferred successively onto the intermediate transfer belt 78 passing through the primary transfer nips formed between the intermediate transfer belt 78 and the primary transfer bias rollers 79Y, 79M, 79C, and 79K. Thus, the yellow, magenta, cyan, and black toner images are superimposed on the same position on the intermediate transfer belt 78, forming a color toner image on the intermediate transfer belt 78.

A secondary transfer roller 89 is pressed against the secondary transfer backup roller 82 via the intermediate transfer belt 78 to form a secondary transfer nip between the secondary transfer roller 89 and the intermediate transfer belt 78. As the color toner image formed on the intermediate transfer belt 78 reaches the secondary transfer nip, the color toner image is secondarily transferred onto a recording medium P conveyed through the secondary transfer nip. After the secondary transfer, the intermediate transfer belt cleaner 80 disposed opposite the intermediate transfer belt 78 collects residual toner failed to be transferred onto the recording medium P and therefore remaining on the intermediate transfer belt 78 therefrom.

A detailed description is now given of conveyance of the recording medium P from the paper tray 12 to the secondary transfer nip.

The paper tray 12 situated in a lower portion of the image forming apparatus 1 loads a plurality of recording media P (e.g., transfer sheets). As a feed roller 97 is driven and rotated counterclockwise in FIG. 1, an uppermost recording medium P of the plurality of recording media P placed on the paper tray 12 is conveyed to a roller nip formed between two registration rollers 98*a* and 98*b*.

As the recording medium P comes into contact with the registration rollers 98*a* and 98*b*, the registration rollers 98*a* and 98*b* that interrupt their rotation halt the recording medium P at the roller nip formed between the registration rollers 98*a* and 98*b* temporarily. At a time when the color toner image formed on the intermediate transfer belt 78 reaches the secondary transfer nip, the registration rollers 98*a* and 98*b* resume their rotation to feed the recording medium P to the secondary transfer nip. As the recording medium P is conveyed through the secondary transfer nip, the color toner image formed on the intermediate transfer belt 78 is secondarily transferred onto the recording medium P.

Thereafter, the recording medium P bearing the color toner image is conveyed to the fixing device 20. As the recording medium P bearing the color toner image is conveyed between a fixing belt 21 and a pressing roller 31, the fixing belt 21 and the pressing roller 31 apply heat and pressure to the recording medium P, fixing the color toner image on the recording medium P.

Thereafter, the recording medium P bearing the fixed color toner image is discharged by output rollers 99*a* and 99*b* and stacked on an outside of the image forming apparatus 1, that is, an output tray 100 disposed atop the image forming apparatus 1. Thus, a series of image forming processes performed by the image forming apparatus 1 is completed.

A description is provided of a configuration of the front cover 40.

The front cover 40, serving as a cover, is located in proximity to the fixing device 20 and pivotable about a pivot 40*a* mounted on a body 50 such that the front cover 40 is pivotally attached to the body 50 of the image forming apparatus 1. FIG. 1 illustrates the front cover 40 that is closed. As the front cover 40 pivots about the pivot 40*a* in a direction A, the front cover 40 is opened with respect to the body 50. Accordingly, the fixing device 20 and components surrounding the fixing device 20 are exposed to the outside of the image forming apparatus 1. Further, as the front cover 40 is opened and closed, a part of components of the fixing device 20 moves in accordance with movement of the front cover 40. A description of such movement is deferred.

With reference to FIGS. 2 to 4B, a description is provided of a configuration of the fixing device 20 according to a first example embodiment that is incorporated in the image forming apparatus 1 described above.

Figure 2:
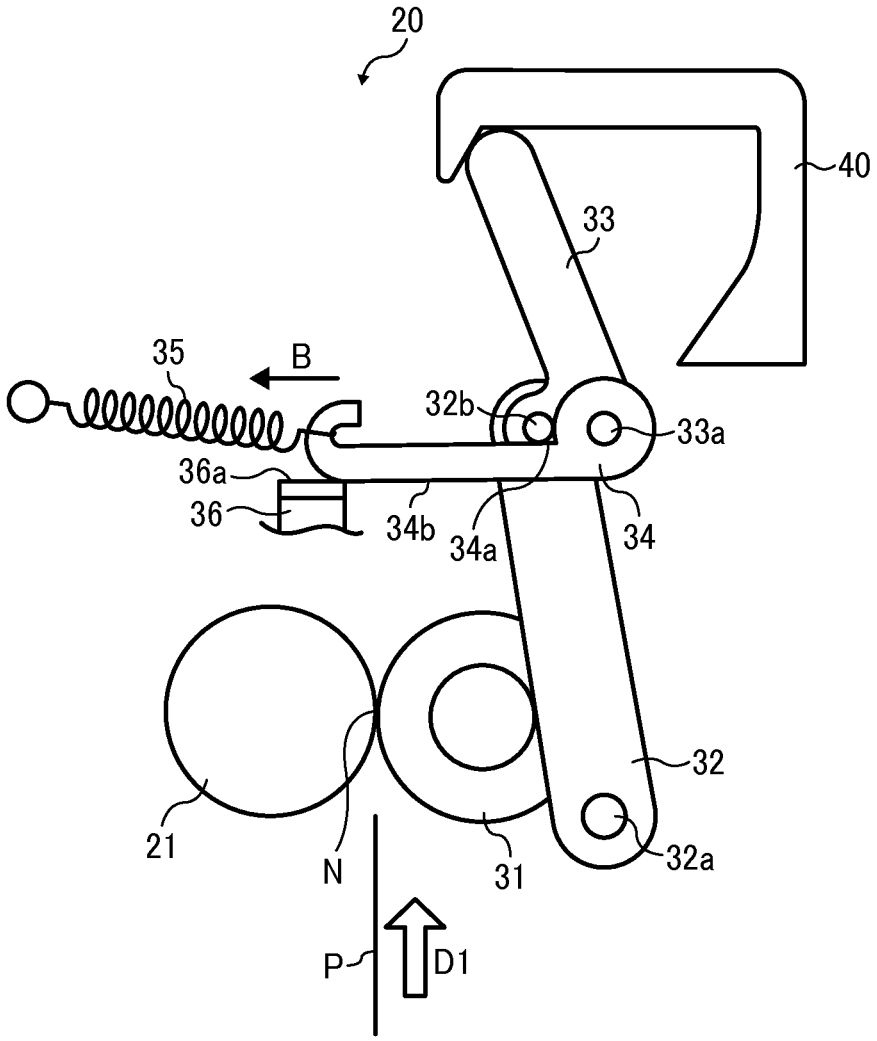
FIG. 2 is a vertical sectional view of a fixing device according to a first example embodiment that is incorporated in the image forming apparatus shown in FIG. 1 illustrating a pressing roller pressed against a fixing belt.
Figure 3:
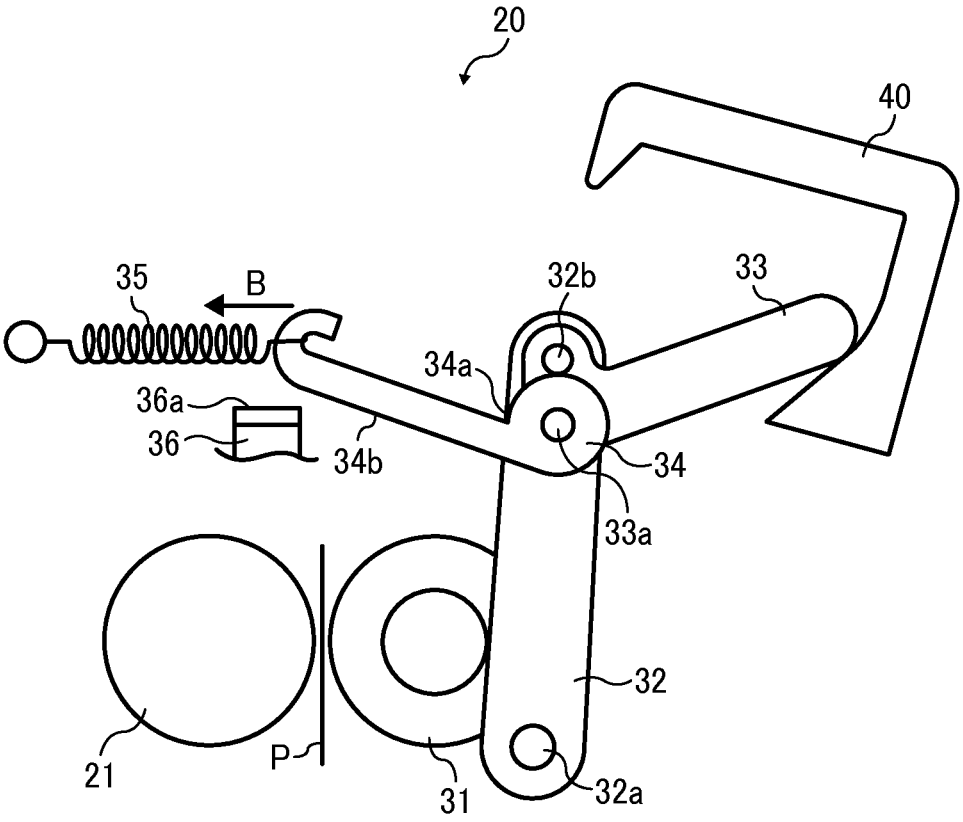
FIG. 3 is a vertical sectional view of the fixing device shown in FIG. 2 illustrating the pressing roller isolated from the fixing belt.
Figure 4A:
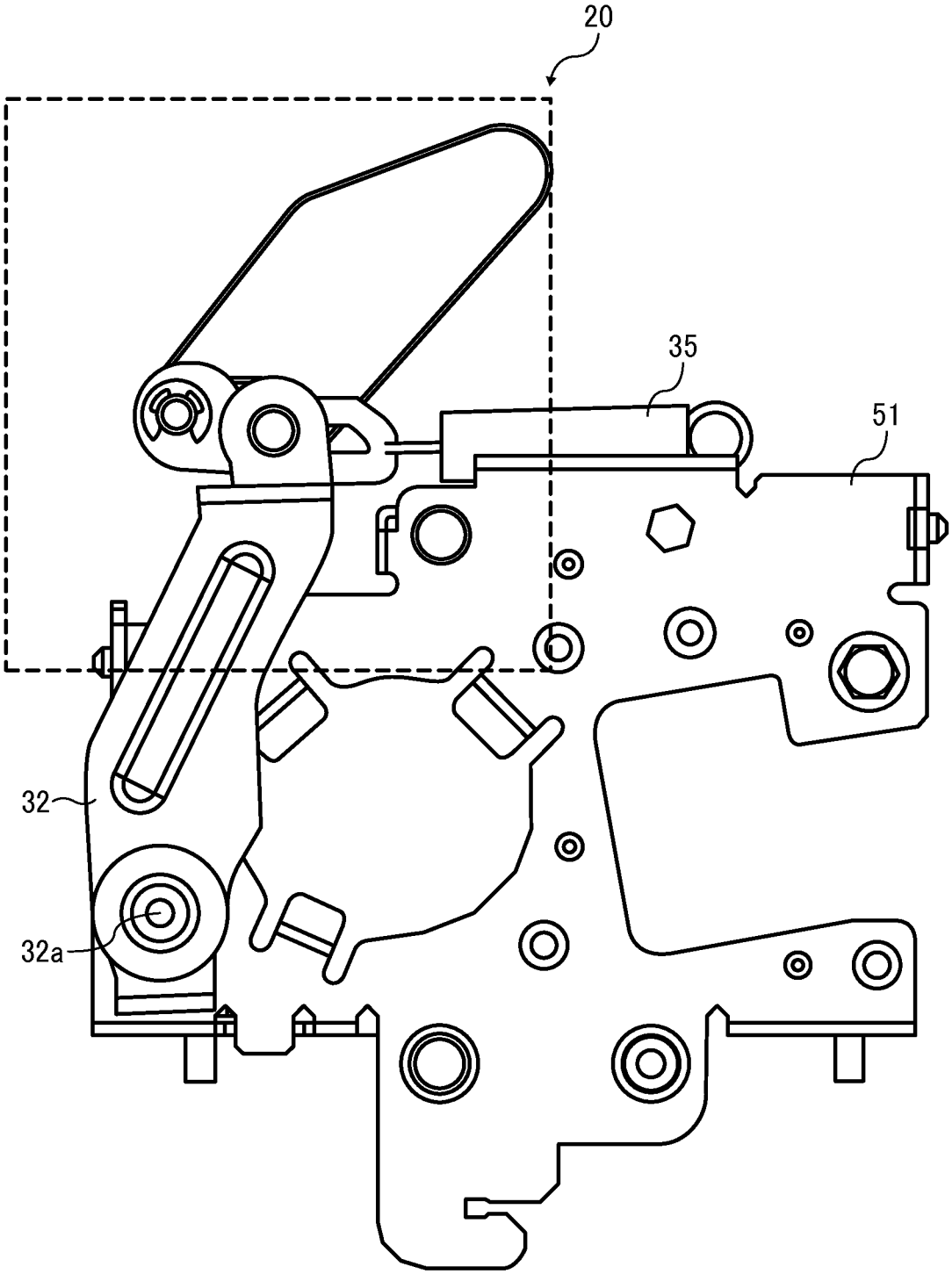
FIG. 4A is a side view of the fixing device shown in FIG. 2.
Figure 4B:
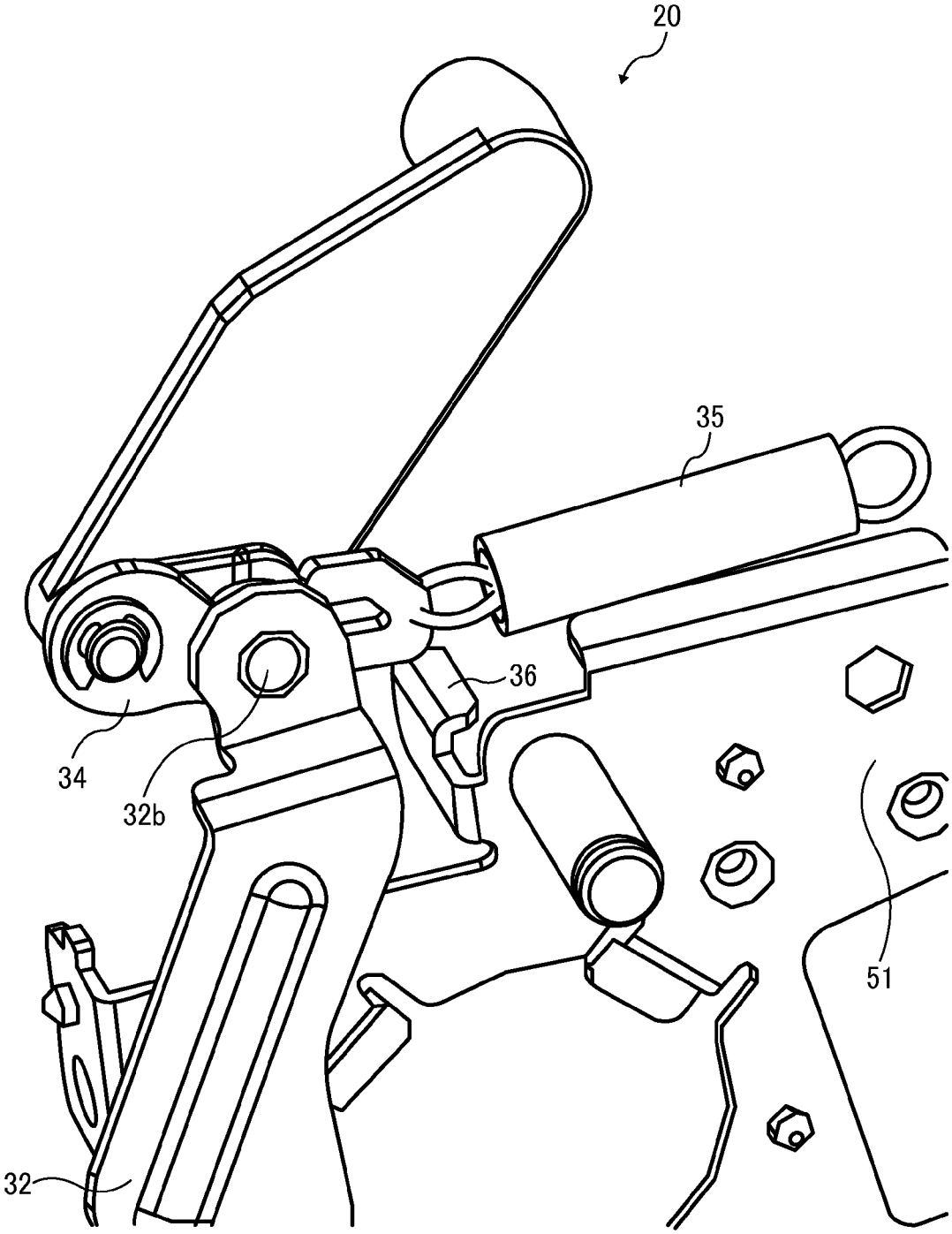
FIG. 4B is a partially enlarged perspective view of the fixing device shown in FIG. 4A.

FIG. 2 is a vertical sectional view of the fixing device 20 in a state in which the pressing roller 31 is pressed against the fixing belt 21. FIG. 3 is a vertical sectional view of the fixing device 20 in a state in which the pressing roller 31 is isolated from the fixing belt 21. FIG. 4A is a side view of the fixing device 20. FIG. 4B is a partially enlarged perspective view of the fixing device 20 illustrating a section indicated by the dotted line in FIG. 4A. As shown in FIGS. 2 and 3, the fixing device 20 includes the fixing belt 21 serving as a fixing rotary body; the pressing roller 31 serving as a pressing rotary body;

a pressurization lever 32 serving as a pressurization member; a depressurization lever 33 serving as a depressurization member; a lock lever 34 serving as a lock; a pressurization spring 35 serving as a biasing member; and a detent 36.

A detailed description is now given of a configuration of the fixing belt 21 serving as a fixing rotary body and the pressing roller 31 serving as a pressing rotary body.

The fixing belt 21 is an endless belt formed into a loop inside which a heater is situated. The pressing roller 31 is pressed against the fixing belt 21 to form a fixing nip N therebetween through which a recording medium P bearing a toner image is conveyed in a recording medium conveyance direction D1. As the recording medium P is conveyed through the fixing nip N, the fixing belt 21 heats the recording medium P to melt toner of the toner image formed on the recording medium P. Simultaneously, the pressing roller 31 pressed against the fixing belt 21 presses the recording medium P against the fixing belt 21. Hence, as the recording medium P is conveyed through the fixing nip N, the fixing belt 21 and the pressing roller 31 apply heat and pressure to the recording medium P, fixing the toner image on the recording medium P.

A detailed description is now given of a configuration of the pressurization lever 32.

The pressurization lever 32 mounting pivots 32*a* and 32*b* is pivotable about the pivot 32*a*. The depressurization lever 33 is pivotable about the pivot 32*b* serving as a pressurization pivot provided on the pressurization lever 32. As shown in FIG. 4A, the pivot 32*a* serves as a pivot shaft rotatably mounted on and supported by a side plate 51 of the fixing device 20. Thus, the side plate 51 serves as a support that supports the pivot 32*b*. As the pressurization lever 32 pivots about the pivot 32*a*, the pressurization lever 32 presses the pressing roller 31 against the fixing belt 21, forming the fixing nip N between the pressing roller 31 and the fixing belt 21. That is, the pressurization lever 32 exerts pressure to the recording medium P via the pressing roller 31, which fixes the toner image on the recording medium P.

A detailed description is now given of a configuration of the depressurization lever 33.

As shown in FIG. 2, the depressurization lever 33 mounts a pivot 33*a* serving as a depressurization pivot provided on the depressurization lever 33. The lock lever 34 is pivotable about the pivot 33*a*. The depressurization lever 33 is pivotally attached to and supported by the pivot 32*b* provided on the pressurization lever 32. The depressurization lever 33 is situated in a pivot trajectory of the front cover 40 and pivotable in accordance with pivot of the front cover 40 as the front cover 40 is opened and closed with respect to the body 50.

FIG. 2 illustrates a pressurization position where the pressing roller 31 is pressed against the fixing belt 21. FIG. 3 illustrates a depressurization position where the pressing roller 31 is isolated from the fixing belt 21. As the depressurization lever 33 pivots clockwise from the pressurization position shown in FIG. 2, the depressurization lever 33 moves to the depressurization position shown in FIG. 3. Conversely, as the depressurization lever 33 pivots counterclockwise from the depressurization position shown in FIG. 3, the depressurization lever 33 moves to the pressurization position shown in FIG. 2.

A detailed description is now given of a configuration of the lock lever 34.

The lock lever 34 is pivotally supported by the pivot 33*a* provided on the depressurization lever 33. As shown in FIG. 2, the lock lever 34 includes an engagement portion 34*a* that is engageable with the pivot 32*b* mounted on the pressurization lever 32 and a contact face 34*b* that comes into contact with a contact face 36*a* of the detent 36. Thus, as the engagement portion 34*a* of the lock lever 34 engages the pivot 32*b* mounted on the pressurization lever 32 as shown in FIG. 2, the pressurization lever 32 presses the pressing roller 31 against the fixing belt 21 at the pressurization position.

A detailed description is now given of a configuration of the pressurization spring 35.

As shown in FIGS. 4A and 4B, one end of the pressurization spring 35 is anchored to the side plate 51 of the fixing device 20; another end of the pressurization spring 35 is anchored to the lock lever 34. Since the pressurization spring 35 exerts a resilient bias in a direction B depicted in FIG. 2, the pressurization spring 35 pulls the lock lever 34 in the direction B. Hence, as the front cover 40 is closed as shown in FIG. 2, the pressurization spring 35 causes the pressurization lever 32 to press the pressing roller 31 against the fixing belt 21. Conversely, as the front cover 40 is opened as shown in FIG. 3, the pressurization spring 35, since it pulls the lock lever 34 in the direction B, facilitates clockwise pivot of the depressurization lever 33.

A detailed description is now given of a configuration of the detent 36.

As shown in FIGS. 2 and 4B, the detent 36 is mounted on the side plate 51 of the fixing device 20, serving as a support that supports the detent 36, and includes the contact face 36*a* contacted by the contact face 34*b* of the lock lever 34. As the lock lever 34 moves from the depressurization position shown in FIG. 3 where the pressing roller 31 is isolated from the fixing belt 21 to the pressurization position shown in FIG. 2 where the pressing roller 31 is pressed against the fixing belt 21, the lock lever 34 comes into contact with and is halted by the contact face 36*a* of the detent 36 as shown in FIG. 2. Thus, the detent 36 prevents the lock lever 34 from being pivoted and angled at an angle greater than an engagement angle at which the engagement portion 34*a* of the lock lever 34 engages the pivot 32*b* mounted on the pressurization lever 32.

An interface between the contact face 34*b* of the lock lever 34 and the contact face 36*a* of the detent 36 is applied or coated with a lubricant (e.g., grease) to reduce frictional resistance between the lock lever 34 and the detent 36.

A detailed description is now given of an operation of the lock lever 34, the pressurization spring 35, and the detent 36.

At the pressurization position shown in FIG. 2 where the pressing roller 31 is pressed against the fixing belt 21, the pressurization spring 35 is elongated in accordance with pivot of the lock lever 34, exerting a resilient bias to the lock lever 34 in the direction B. Since the resilience bias of the pressurization spring 35 is against a pivotal force of the depressurization lever 33, the resilient bias of the pressurization spring 35 may be suppressed to reduce the pivotal force of the depressurization lever 33.

The length of the pressurization spring 35 is maximized into an engagement length when the engagement portion 34*a* of the lock lever 34 engages the pivot 32*b* of the pressurization lever 32. However, if the lock lever 34 pivots counterclockwise to a position further than an engagement angled position where the engagement portion 34*a* of the lock lever 34 engages the pivot 32*b* at the engagement angle, the pressurization spring 35 is elongated to a length greater than the engagement length of the pressurization spring 35. Accordingly, the pressurization spring 35 exerts an excessive resilient bias to the lock lever 34.

To address this circumstance, the detent 36 contacts and halts the contact face 34*b* of the lock lever 34 as the lock lever 34 pivots counterclockwise in FIG. 2, thus preventing the lock lever 34 from being pivoted and angled at an angle greater than the engagement angle at which the engagement portion 34*a* of the lock lever 34 engages the pivot 32*b* mounted on the pressurization lever 32.

With reference to FIGS. 2 and 5 to 7, a description is provided of an operation of the fixing device 20 when the pressing roller 31 is pressed against the fixing belt 21.

Figure 5:
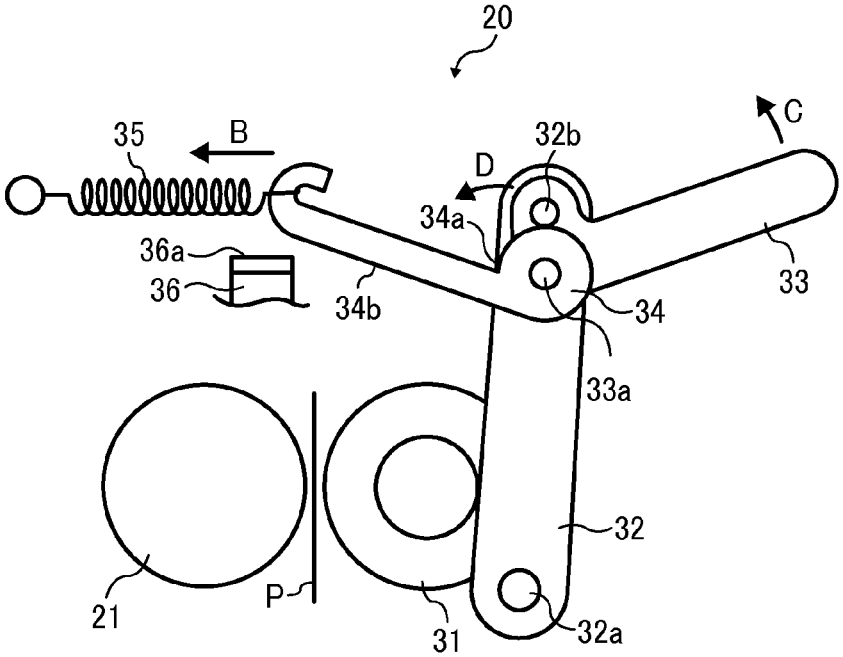
FIG. 5 is a vertical sectional view of the fixing device shown in FIG. 3 illustrating a pressurization lever starting pressing the pressing roller against the fixing belt.
Figure 6:
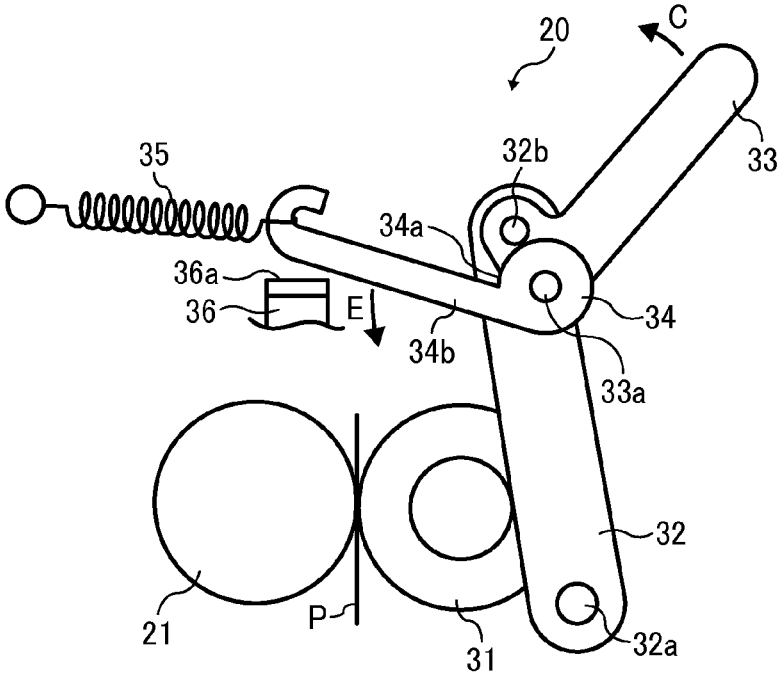
FIG. 6 is a vertical sectional view of the fixing device shown in FIG. 2 illustrating the pressing roller in contact with the fixing belt.
Figure 7:
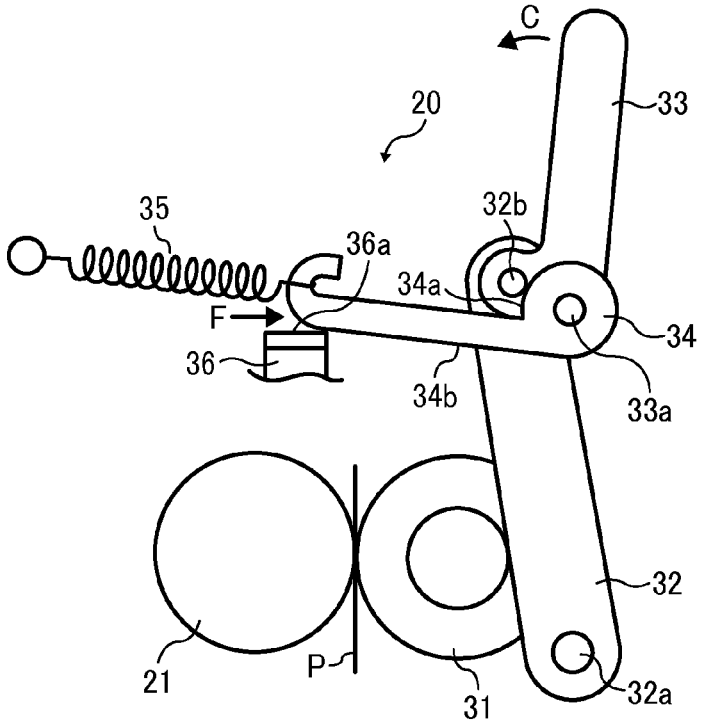
FIG. 7 is a vertical sectional view of the fixing device shown in FIG. 2 illustrating a lock lever in contact with a detent.

FIG. 5 is a vertical sectional view of the fixing device 20 illustrating the pressurization lever 32 starting pressing the pressing roller 31 against the fixing belt 21. FIG. 6 is a vertical sectional view of the fixing device 20 illustrating the pressing roller 31 in contact with the fixing belt 21. FIG. 7 is a vertical sectional view of the fixing device 20 illustrating the lock lever 34 in contact with the detent 36. It is to be noted that although FIGS. 5 to 7 do not illustrate the front cover 40, the depressurization lever 33 pivots in accordance with pivot of the front cover 40 as it is opened and closed with respect to the body 50.

As the depressurization lever 33 pivots counterclockwise in FIG. 5 in a direction C as a user or a service engineer starts closing the front cover 40 contacting the depressurization lever 33, the resilient bias of the pressurization spring 35 pivots the pressurization lever 32 about the pivot 32*a* in a direction D, causing the pressurization lever 32 to move the pressing roller 31 toward the fixing belt 21.

As the pressing roller 31 comes into contact with the fixing belt 21, pivot of the pressurization lever 32 contacting the pressing roller 31 is restricted. Conversely, however, the depressurization lever 33 continues pivoting. Accordingly, as shown in FIG. 6, the lock lever 34 pivots in a direction E in accordance with pivot of the depressurization lever 33.

As shown in FIG. 7, when the lock lever 34 pivots to the engagement angled position where the engagement portion 34*a* of the lock lever 34 engages the pivot 32*b* mounted on the pressurization lever 32 at the engagement angle, the contact face 34*b* of the lock lever 34 comes into contact with the contact face 36*a* of the detent 36. Accordingly, the detent 36 prevents the lock lever 34 from pivoting further than the engagement angled position where the engagement portion 34*a* of the lock lever 34 engages the pivot 32*b* mounted on the pressurization lever 32 at the engagement angle. Then, the lock lever 34, while the contact face 34*b* thereof contacts the contact face 36*a* of the detent 36, moves in a direction F in accordance with pivot of the depressurization lever 33. Accordingly, the engagement portion 34*a* of the lock lever 34 comes into engagement with the pivot 32*b* mounted on the pressurization lever 32 at the pressurization position shown in FIG. 2.

A description is provided of advantages of the fixing device 20.

As shown in FIG. 2, the fixing device 20 includes the fixing belt 21 that heats the recording medium P bearing the toner image and the pressing roller 31 that exerts pressure to the recording medium P. The fixing belt 21 and the pressing roller 31 disposed opposite the fixing belt 21, as they sandwich the recording medium P, apply heat and pressure to the recording medium P, fixing the toner image on the recording medium P.

The fixing device 20 further includes the pressurization lever 32, the depressurization lever 33, the lock lever 34, and the detent 36. The pressurization lever 32 presses the pressing roller 31 against the fixing belt 21. The depressurization lever 33 pivots about the pivot 32*b* provided on the pressurization lever 32 clockwise to move the pressurization lever 32 to the depressurization position shown in FIG. 3 where the pressurization lever 32 does not press the pressing roller 31 against the fixing belt 21 and therefore isolates the pressing roller 31 from the fixing belt 21. The lock lever 34, pivotable about the pivot 33*a* provided on the depressurization lever 33, is pulled by the pressurization spring 35 that exerts a resilient bias to the lock lever 34 to press the pressing roller 31 against the fixing belt 21. The detent 36 is situated in the pivot trajectory of the lock lever 34 to restrict pivot of the lock lever 34.

Accordingly, the detent 36 contacts and halts the lock lever 34 at the engagement angled position where the engagement portion 34*a* of the lock lever 34 engages the pivot 32*b* mounted on the pressurization lever 32, preventing the pressurization spring 35 from being elongated to a length greater than the engagement length of the pressurization spring 35 great enough to engage the engagement portion 34*a* with the pivot 32*b*. Consequently, the pressurization spring 35 does not exert an excessive resilient bias to the lock lever 34, reducing a force to pivot the depressurization lever 33.

Since the detent 36 reduces the force to pivot the depressurization lever 33, even if the image forming apparatus 1 depicted in FIG. 1 is downsized and therefore does not accommodate relatively great levers that achieve great leverage, the user or the service engineer can move the depressurization lever 33 readily. Hence, the image forming apparatus 1 installed with the fixing device 20 incorporating the detent 36 is downsized at reduced manufacturing costs.

The detent 36 is mounted on the side plate 51 of the fixing device 20 that rotatably mounts the pivot 32*a* pivotally mounting the pressurization lever 32. Accordingly, even if the pressurization lever 32, the depressurization lever 33, and the lock lever 34 pivot, the detent 36 is stationarily secured to the side plate 51 of the fixing device 20, allowing the contact face 34*b* of the lock lever 34 to come into contact with the contact face 36*a* of the detent 36 at an identical position constantly as shown in FIG. 7. Consequently, the detent 36 restricts further pivot or movement of the lock lever 34 from the engagement angled position shown in FIG. 7 where the engagement portion 34*a* of the lock lever 34 engages the pivot 32*b* mounted on the pressurization lever 32 stably.

Further, the interface between the contact face 34*b* of the lock lever 34 and the contact face 36*a* of the detent 36 is applied or coated with a lubricant such as grease. Accordingly, the lubricant reduces frictional resistance between the lock lever 34 and the detent 36, reducing a force to move the depressurization lever 33.

The depressurization lever 33 is situated in the pivot trajectory of the front cover 40 protecting the fixing device 20 from contaminants outside, on which the front cover 40 moves as it is opened and closed with respect to the body 50 so that the depressurization lever 33 pivots in accordance with movement of the front cover 40. Accordingly, if the recording medium P is jammed between the pressing roller 31 and the fixing belt 21, the pressing roller 31 separates from the fixing belt 21 as the user opens the front cover 40. Consequently, the user can remove the jammed recording medium P from the fixing device 20 readily.

Figure 8:
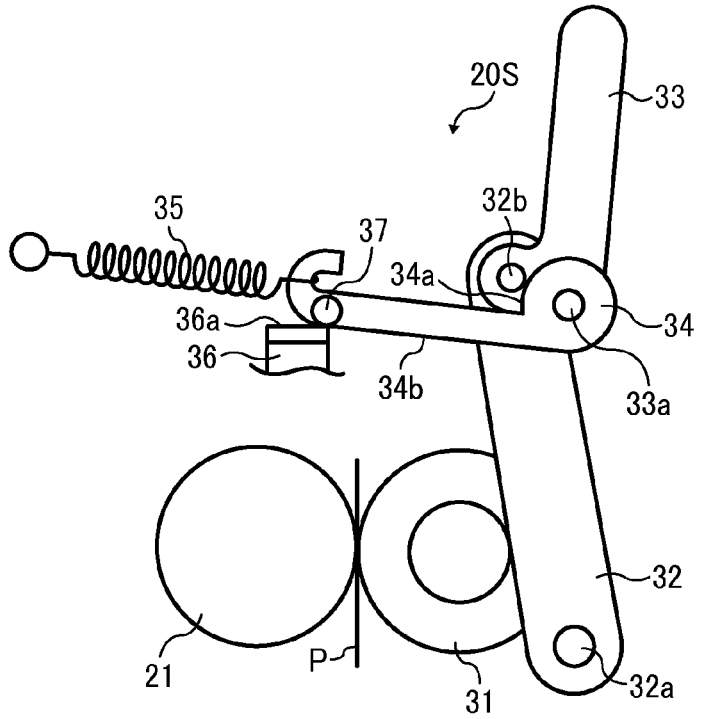
FIG. 8 is a vertical sectional view of a fixing device as a variation of the fixing device shown in FIG. 7.

According to the example embodiment shown in FIG. 7, the contact face 34*b* of the lock lever 34 is planar. Alternatively, the lock lever 34 may be attached with a roller 37 as shown in FIG. 8. FIG. 8 is a vertical sectional view of a fixing device 20S incorporating the roller 37.

As shown in FIG. 8, the roller 37 serving as a rotary member contacts the contact face 36*a* of the detent 36, decreasing frictional resistance between the lock lever 34 and the detent 36 and thereby reducing a force to move the depressurization lever 33. Since the roller 37 rolls on the contact face 36*a* of the detent 36, that is, the roller 37 contacts the contact face 36*a* of the detent 36 with a changing section on an outer circumferential surface of the roller 37, the roller 37 prevents the lock lever 34 from being caught by the detent 36, facilitating stable pivot of the depressurization lever 33 coupled to the lock lever 34.

Figure 9:
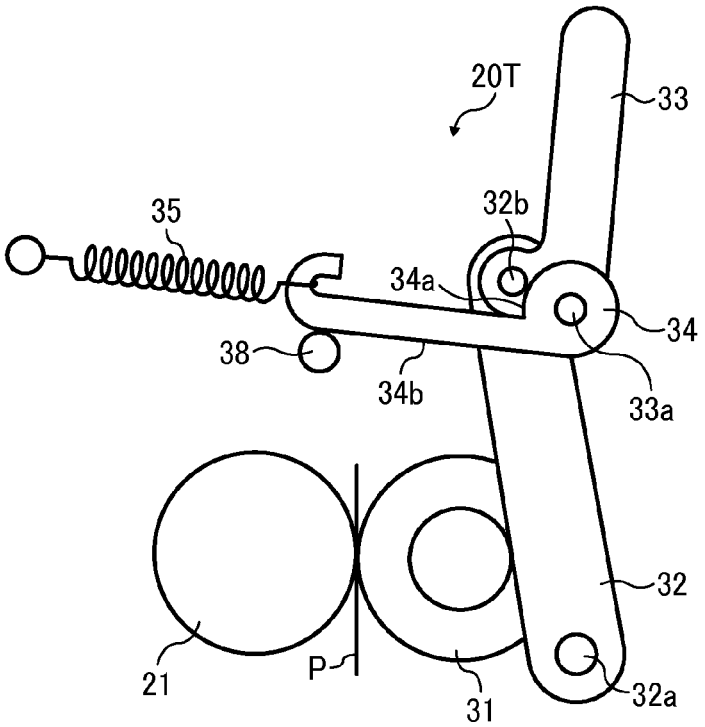
FIG. 9 is a vertical sectional view of a fixing device according to a second example embodiment.
Figure 10:
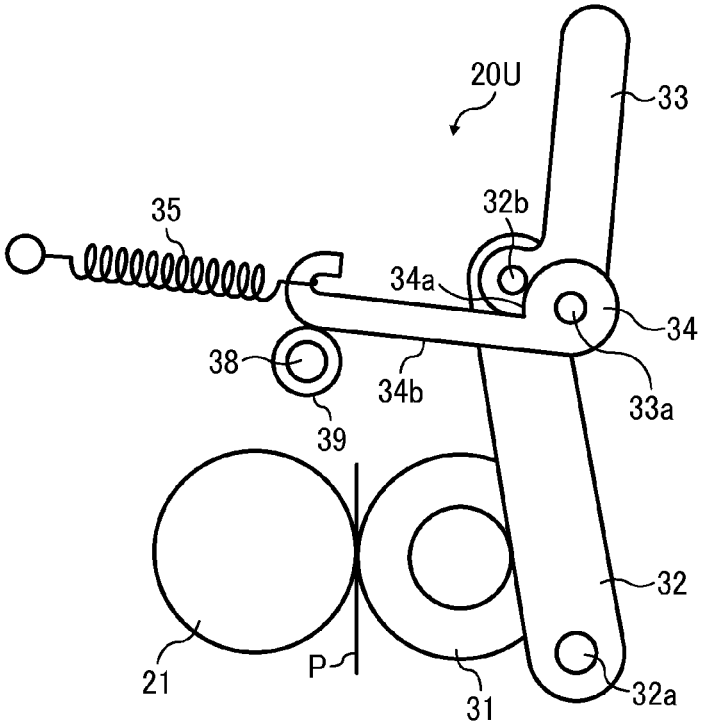
FIG. 10 is a vertical sectional view of a fixing device as a variation of the fixing device shown in FIG. 9.

With reference to FIGS. 9 and 10, a description is provided of a configuration of fixing devices 20T and 20U according to a second example embodiment.

FIG. 9 is a vertical sectional view of the fixing device 20T. FIG. 10 is a vertical sectional view of the fixing device 20U. As shown in FIG. 9, the fixing device 20T includes a detent shaft 38 instead of the detent 36 shown in FIG. 7. As shown in FIG. 10, the fixing device 20U includes the detent shaft 38 and a roller 39. Although FIGS. 9 and 10 omit the front cover 40, the depressurization lever 33 pivots about the pivot 32*b* in accordance with pivot of the front cover 40 as the user or the service engineer opens and closes the front cover 40.

As shown in FIG. 9, the fixing device 20T incorporates the detent shaft 38 serving as a detent that restricts pivot of the lock lever 34. For example, as the user or the service engineer closes the front cover 40 as shown in FIG. 2 and therefore the lock lever 34 pivots counterclockwise to the engagement angled position shown in FIG. 9 where the engagement portion 34*a* of the lock lever 34 engages the pivot 32*b* provided on the pressurization lever 32, the contact face 34*b* of the lock lever 34 comes into contact with and is halted by the detent shaft 38. Thus, the detent shaft 38 restricts further pivot of the lock lever 34. As the contact face 34*b* of the lock lever 34 contacts the detent shaft 38, the detent shaft 38 prevents the lock lever 34 from being caught by the detent shaft 38, facilitating stable movement of the depressurization lever 33 coupled to the lock lever 34.

According to this example embodiment shown in FIG. 9, the detent shaft 38 contacts the contact face 34*b* of the lock lever 34 directly. Alternatively, the roller 39 mounted on the detent shaft 38 may contact the contact face 34*b* of the lock lever 34 directly as shown in FIG. 10. For example, the roller 39 serves as a rotary body rotatable about the detent shaft 38 and as a detent that restricts pivot of the lock lever 34 by contacting it. The roller 39 is made of a heat resistant material. The roller 39 is applied or coated with grease on at least one of an inner circumferential surface and an outer circumferential surface thereof. The roller 39 contacting the contact face 34*b* of the lock lever 34 decreases frictional resistance between the lock lever 34 and the detent shaft 38 and thereby reducing a force to move the depressurization lever 33. Since the roller 39 rolls on the contact face 34*b* of the lock lever 34, that is, the roller 39 contacts the contact face 34*b* of the lock lever 34 with a changing section on the outer circumferential surface of the roller 39, the roller 39 prevents the lock lever 34 from being caught by the roller 39, facilitating stable movement of the depressurization lever 33 coupled to the lock lever 34.

With reference to FIGS. 2, 3, and 8 to 10, a description is provided of advantages of the fixing devices 20, 20S, 20T, and 20U described above.

The fixing device (e.g., fixing devices 20, 20S, 20T, and 20U) includes a fixing rotary body (e.g., the fixing belt 21) to heat a recording medium P bearing a toner image and a pressing rotary body (e.g., the pressing roller 31) to exert pressure to the recording medium P. As the fixing rotary body and the pressing rotary body disposed opposite the fixing rotary body sandwich the recording medium P conveyed therebetween, the fixing rotary body and the pressing rotary body apply heat and pressure to the recording medium P, thus fixing the toner image on the recording medium P. A pressurization member (e.g., the pressurization lever 32) presses the pressing rotary body against the fixing rotary body. A depressurization member (e.g., the depressurization lever 33), pivotable about a pressurization shaft (e.g., the pivot 32*b*) provided on the pressurization member, causes the pressurization member to isolate the pressing rotary body from the fixing rotary body. A lock (e.g., the lock lever 34), pivotable about a depressurization shaft (e.g., the pivot 33*a*) provided on the depressurization member, is anchored with a biasing member (e.g., the pressurization spring 35). The lock causes the pressurization member to press the pressing rotary body against the fixing rotary body by a resilient bias of the biasing member. The detent (e.g., the detent 36, the detent shaft 38, and the roller 39) is situated in the pivot trajectory of the lock to restrict pivot of the lock.

Accordingly, even if the fixing device is installed in the compact image forming apparatus, the user or the service engineer can move the depressurization member readily with a reduced force to cause the pressurization member to press the pressing rotary body against the fixing rotary body and isolate the pressing rotary body from the fixing rotary body.

According to the example embodiments described above, the fixing belt 21 serves as a fixing rotary body. Alternatively, a fixing roller or the like may serve as a fixing rotary body. The example embodiments described above are also applicable to a device including a first rotary body and a second rotary body pressed against the first rotary body to form a nip therebetween other than the fixing device for fixing a toner image on a recording medium.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing rotary body;

a pressing rotary body disposed opposite the fixing rotary body;

a pivotable pressurization member to contact and press the pressing rotary body against the fixing rotary body;

a pressurization pivot provided on the pressurization member;

a depressurization member, pivotable about the pressurization pivot, to cause the pressurization member to isolate the pressing rotary body from the fixing rotary body;

a depressurization pivot provided on the depressurization member;

a lock pivotally fixed to the depressurization pivot at a first end of the lock and engageable with the pressurization pivot at the first end of the lock;

a biasing member, anchored to the lock at a second end of the lock, to exert a resilient bias that allows the lock to cause the pressurization member to press the pressing rotary body against the fixing rotary body; and a detent at the second end of the lock and situated in a pivotal trajectory of the second end of the lock to restrict pivot of the lock by contacting the lock.

2. The fixing device according to claim 1, further comprising a support to support the detent.

3. The fixing device according to claim 2, further comprising a pivot shaft rotatably mounted on the support, the pivot shaft about which the pressurization member is pivotable.

4. The fixing device according to claim 2, wherein the support includes a side plate.

5. The fixing device according to claim 1, further comprising a rotary member, attached to the lock, to come into contact with the detent.

6. The fixing device according to claim 5, wherein the rotary member includes a roller.

7. The fixing device according to claim 1, wherein the detent includes a detent shaft.

8. The fixing device according to claim 7, wherein the detent further includes a roller mounted on the detent shaft and contacted by the lock.

9. The fixing device according to claim 8, wherein the roller is made of a heat resistant material.

10. The fixing device according to claim 8, wherein the roller is coated with a lubricant on at least one of an inner circumferential surface and an outer circumferential surface thereof.

11. The fixing device according to claim 1, wherein the lock includes a contact face to come into contact with the detent and the detent includes a contact face contacted by the contact face of the lock, and wherein the contact face of the lock and the contact face of the detent are coated with a lubricant.

12. The fixing device according to claim 1, further comprising a pivotable cover openable and closable to protect the fixing device, the cover contacting the depressurization member, wherein the depressurization member is situated in a pivotal trajectory of the cover and pivots about the pressurization pivot in accordance with pivot of the cover.

13. The fixing device according to claim 12, wherein the lock includes an engagement portion engageable with the pressurization pivot provided on the pressurization member.

14. The fixing device according to claim 13, wherein, when the cover is closed, the cover pivots the depressurization member about the pressurization pivot to a pressurization position where the pressurization pivot engages the engagement portion of the lock to cause the pressurization member to press the pressing rotary body against the fixing rotary body.

15. The fixing device according to claim 14, wherein, when the depressurization member is at the pressurization position, the pressurization pivot engaging the engagement portion of the lock brings the lock into contact with the detent.

16. The fixing device according to claim 13, wherein, when the cover is opened, the cover pivots the depressurization member about the pressurization pivot to a depressurization position where the pressurization pivot disengages the engagement portion of the lock to cause the pressurization member to isolate the pressing rotary body from the fixing rotary body.

17. The fixing device according to claim 16, wherein, when the depressurization member is at the depressurization position, the pressurization pivot disengaging the engagement portion of the lock brings the lock into isolation from the detent.

18. The fixing device according to claim 1, wherein the pressurization member includes a pressurization lever, the depressurization member includes a depressurization lever, and the lock includes a lock lever.

19. The fixing device according to claim 1, wherein the biasing member includes a spring.

20. An image forming apparatus comprising the fixing device according to claim 1.

* * * * *